US005377566A

United States Patent [19]

Mandigo

[11] Patent Number: 5,377,566

[45] Date of Patent: Jan. 3, 1995

[54] ADJUSTABLE RATCHET WRENCH APPARATUS

[76] Inventor: Wallace L. Mandigo, 126 SE. 3rd St., College Place, Wash. 99324

[21] Appl. No.: 199,010

[22] Filed: Feb. 18, 1994

[51] Int. Cl.[6] ..... B25B 13/46

[52] U.S. Cl. ..... 81/58.2; 81/163; 81/165

[58] Field of Search ..... 81/58.2, 60–63.2, 81/155, 163, 165, 167, 170, DIG. 4

[56] References Cited

U.S. PATENT DOCUMENTS

| | | | |
|---|---|---|---|
| 894,641 | 7/1908 | Higbee | 81/58.2 |
| 920,372 | 5/1909 | McDaniel | 81/163 |
| 923,942 | 6/1909 | Brockway | 81/58.2 |
| 1,373,180 | 3/1921 | Durgan et al. | 81/58.2 |
| 1,391,764 | 9/1921 | Dixon | 81/163 |
| 1,551,763 | 9/1925 | Morris | 81/165 |
| 2,521,419 | 9/1950 | Sellers | 81/63.1 |
| 2,524,689 | 10/1950 | Westman | 81/165 |
| 3,803,954 | 4/1974 | Lenker . | |
| 4,112,792 | 9/1978 | Guimarin . | |
| 4,277,991 | 7/1981 | Stubenrauch | 81/170 |
| 5,040,439 | 8/1991 | Chapman . | |
| 5,090,273 | 2/1992 | Fossella . | |
| 5,095,782 | 3/1992 | Galea . | |

FOREIGN PATENT DOCUMENTS

| | | | |
|---|---|---|---|
| 660009 | 7/1929 | France | 81/58.2 |

*Primary Examiner*—D. S. Meislin

[57] ABSTRACT

A new and improved adjustable ratchet wrench apparatus includes a handle assembly and a wrench head assembly which includes a ratchet assembly and a jaw assembly. The ratchet assembly includes a ratchet assembly housing connected to the handle assembly. The ratchet assembly housing is substantially C-shaped and includes a first free-ended portion and a second free-ended portion. A first gap is provided between a first free end of the first free-ended portion and a second free end of the second free-ended portion. The ratchet assembly includes a first ratchet element supported by the ratchet assembly housing. The first ratchet element permits unidirectional rotation of the jaw assembly. The jaw assembly includes a substantially C-shaped jaw assembly housing which is nested within and is supported by the ratchet assembly housing for relative rotation between the ratchet assembly housing and the jaw assembly housing. The jaw assembly housing is capable of rotating 360 degrees repetitively within the ratchet assembly housing. The jaw assembly housing includes peripheral gear teeth that are engaged by the first ratchet element. A second gap is provided between a first free end and a second free end of the jaw assembly housing. The jaw assembly includes a jaw-adjustment assembly connected to the jaw assembly housing for adjusting a third gap between the first jaw member and the second jaw member such that the first jaw member and the second jaw member are adjusted onto a nut or bolt.

5 Claims, 6 Drawing Sheets

ADJUSTABLE RATCHET WRENCH APPARATUS

BACKGROUND OF THE INVENTION

1. Field of the Invention

The present invention relates generally to ratchet wrenches and, more particularly, to ratchet wrenches having adjustable jaws.

2. Description of the Prior Art

Ratchet wrenches are well known in the art and most commonly include an assembly which includes a handle, a ratchet mechanism attached to the handle, and an adaptor for receiving a socket. A set of different size sockets is provided to attach to the adaptor on the handle-ratchet assembly. Bolt heads, for which sockets are made to fit, common in a variety of sizes. Moreover, in one convention, the bolt heads and the sockets are dimensioned according to the Metric system. In another convention, the bolt heads and the sockets are dimensioned according to the English system. Although a single handle-ratchet assembly may be used with a wide variety of socket sizes, it would be desirable if an adjustable ratchet wrench could be provided which would avoid the need for a wide variety of differently sized sockets.

Throughout the years, a number of innovations have been developed relating to adjustable ratchet wrenches, and the following U.S. patents are representative of some of those innovations: U.S. Pat. Nos. 3,803,954; 4,112,792; 5,040,439; 5,090,273; and 5,095,782.

More specifically, U.S. Pat. Nos. 3,803,954 and 5,095,782 disclose adjustable ratchet wrenches which have a handle that pivots with respect to the jaws of the wrench. The pivoting action serves two purposes. One purpose is to tighten the wrench jaws on a nut or bolt. The other purpose is to turn the nut or bolt. In using this type of adjustable ratchet wrench, a relatively large portion of the motion of the handle in using the wrench is consumed by tightening the jaws of the wrench on the nut or bolt. Therefore, a reduced portion of the motion of the handle is utilized for the main function of the wrench which is turning the nut or bolt. In this respect, it would be desirable if an adjustable ratchet wrench device were provided in which substantially all of the motion of the handle of the device were utilized in turning the nut or bolt.

U.S. Pat. No. 4,112,792 discloses an adjustable ratchet wrench which has a closed box end. A disadvantage of the adjustable ratchet wrench in this patent is that the end of the wrench is closed. In many instances, an open-ended wrench is needed for a variety of applications, and a closed ended wrench will simply not work. In this respect, it would be desirable if an adjustable ratchet wrench device were provided which included an open-ended wrench.

U.S. Pat. No. 5,040,439 discloses an adjustable wrench that employs a chain for tightening around a pipe. The chain is employed to exert clamping pressure on the pipe to assure a secure grip. However, the chain is a bulky item. In this respect, it would be desirable if an adjustable ratchet wrench device were provided which did not employ a chain for gripping a pipe.

U.S. Pat. No. 5,090,273 discloses an adjustable ratchet wrench which includes three sliding jaws which are opened and closed by a cam disk. For purposes of simplicity, it would be desirable if an adjustable ratchet wrench were provided that has only one adjustable jaw.

Still other features would be desirable in an adjustable ratchet wrench apparatus. Locking pliers are well known in the art. With a locking pliers, a clamping force is exerted on an object by the jaws of the pliers, and the jaws are locked into a clamping force exerting mode. None of the prior art devices discussed hereinabove have a locking-plier feature, and it would be desirable if an adjustable ratchet wrench apparatus were provided which included a mechanism for locking the jaws of the adjustable ratchet wrench apparatus onto an object.

A simple ratchet mechanism works to ratchet in one direction. To provide a ratcheting action in two directions, that is both clockwise and counterclockwise, two ratchets must be provided, one for each direction. For purposes of simplicity, it would be desirable if a unidirectional ratcheting mechanism were provided in an adjustable ratchet wrench apparatus. With a unidirectional ratcheting mechanism, the adjustable ratchet wrench apparatus would be flipped over to reverse the operative direction of the unidirectional ratcheting mechanism. More specifically, a ratcheting mechanism that ratchets in a clockwise manner will ratchet in a counterclockwise manner when flipped over.

Thus, while the foregoing body of prior art indicates it to be well known to use adjustable ratchet wrenches, the prior art described above does not teach or suggest an adjustable ratchet wrench apparatus which has the following combination of desirable features: (1) avoids the need for a wide variety of differently sized sockets; (2) employs substantially all of the motion of the handle of the device in turning a nut or bolt; (3) includes an open-ended wrench; (4) does not employ a chain for gripping a pipe; (5) can have only one adjustable jaw: (6) can include a mechanism for locking the jaws of the adjustable ratchet wrench apparatus onto an object; and (7) provides a unidirectional ratcheting mechanism. The foregoing desired characteristics are provided by the unique adjustable ratchet wrench apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved adjustable ratchet wrench apparatus which includes a handle assembly and a wrench head assembly connected to the handle assembly. The wrench head assembly includes a ratchet assembly and a jaw assembly supported by the ratchet assembly. The ratchet assembly includes a ratchet assembly housing connected to the handle assembly. The ratchet assembly housing is substantially C-shaped and includes a base portion connected to the handle assembly. A first free-ended portion of the ratchet assembly housing extends from the base portion, and a second free-ended portion of the ratchet assembly housing extends from the base portion. A first gap is provided between a first free end of the first free-ended portion and a second free end of the second free-ended portion.

The ratchet assembly includes a first ratchet element supported by the ratchet assembly housing. The first ratchet element permits unidirectional rotation of the jaw assembly.

The jaw assembly includes a substantially C-shaped jaw assembly housing which is nested within and is supported by the ratchet assembly housing for relative rotation between the ratchet assembly housing and the jaw assembly housing. The jaw assembly housing is capable of rotating 360 degrees repetitively within the ratchet assembly housing. The jaw assembly housing includes peripheral gear teeth that are engaged by the first ratchet element. A second gap is provided between a first free end and a second free end of the jaw assembly housing.

The jaw assembly includes a first jaw member and a second jaw member which are connected to the jaw assembly housing. The jaw assembly includes a jaw-adjustment assembly connected to the jaw assembly housing for adjusting a third gap between the first jaw member and the second jaw member. The first jaw member and the second jaw member includes flat front surfaces for engaging a fastener.

In one embodiment of the invention, the jaw-adjustment assembly includes a unidirectionally threaded screw supported by beatings in the jaw assembly housing. The first jaw member is fixed with respect to the jaw assembly housing, and the second jaw member includes a threaded portion which engages the unidirectionally threaded screw such that the second jaw member is movable by the unidirectionally threaded screw with respect to the first jaw member. The second jaw member is supported on a guide rod that is supported by the jaw assembly housing, and the second jaw member includes an internal channel through which the guide rod passes.

In another embodiment of the invention, a second ratchet element may be supported by the ratchet assembly housing for engaging the peripheral gear teeth of the jaw assembly housing. The second ratchet element permits unidirectional rotation of the jaw assembly in a direction opposite to the unidirectional rotation of the jaw assembly permitted by the first ratchet element.

In still another embodiment, the jaw-adjustment assembly may include a bidirectionally threaded screw supported by the jaw assembly housing. The first jaw member includes a threaded portion which engages a first threaded portion of the bidirectionally threaded screw such that the first jaw member is movable by the bidirectionally threaded screw with respect to the jaw assembly housing. In addition, the second jaw member includes a threaded portion which engages a second threaded portion of the bidirectionally threaded screw such that the second jaw member is movable by the bidirectionally threaded screw with respect to the jaw assembly housing.

In yet another embodiment, the jaw-adjustment assembly includes a unidirectionally threaded screw. The first jaw member is fixed with respect to the jaw assembly housing, and the second jaw member includes a threaded portion which engages the unidirectionally threaded screw such that the second jaw member is movable by the unidirectionally threaded screw with respect to the first jaw member. In addition, a jaw-locking assembly is connected to the first jaw member. The jaw-locking assembly includes a pivoted face plate juxtaposed to a front face of the first jaw member. An eccentric locking cam is supported by the first jaw member and is located adjacent to the face plate. The eccentric locking cam includes an unlocking mode in which the eccentric locking cam is positioned such that a rear surface of the face plate is permitted to be flush against front face of the first jaw member. The eccentric locking cam also include a continuum of locking modes in which the eccentric locking cam is positioned such that the eccentric locking cam pushes the face plate away from the front face of the first jaw member and toward the second jaw member.

The eccentric locking cam includes a socket adapted to receive an Allen wrench, and an Allen wrench is employed to operate the eccentric locking cam. A stop element is supported by the jaw assembly housing for preventing movement of the Allen wrench when the Allen wrench has been used to lock the eccentric locking cam against the face plate.

In still another embodiment, the face plate includes a grooved front face which faces toward the second jaw member, and the second jaw member includes a grooved front face which faces toward the face plate. The grooved front face is concave, and the grooved front face is concave.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least five preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved adjustable ratchet wrench apparatus which has all of the advantages of the prior art and none of the disadvantages.

It is another object of the present invention to provide a new and improved adjustable ratchet wrench apparatus which may be easily and efficiently manufactured and marketed.

It is a further object of the present invention to provide a new and improved adjustable ratchet wrench apparatus which is of durable and reliable construction.

An even further object of the present invention is to provide a new and improved adjustable ratchet wrench apparatus which is susceptible of a low cost of manufacture with regard to both materials and labor, and which accordingly is then susceptible of low prices of sale to the consuming public, thereby making such adjustable ratchet wrench apparatus available to the buying public.

Still yet a further object of the present invention is to provide a new and improved adjustable ratchet wrench apparatus which avoids the need for a wide variety of differently sized sockets.

Still another object of the present invention is to provide a new and improved adjustable ratchet wrench apparatus that employs substantially all of the motion of the handle of the device in turning a nut or bolt.

Yet another object of the present invention is to provide a new and improved adjustable ratchet wrench apparatus which includes an open-ended wrench.

Even another object of the present invention is to provide a new and improved adjustable ratchet wrench apparatus that does not employ a chain for gripping a pipe.

Still a further object of the present invention is to provide a new and improved adjustable ratchet wrench apparatus which can have only one adjustable jaw.

Yet another object of the present invention is to provide a new and improved adjustable ratchet wrench apparatus that can include a mechanism for locking the jaws of the adjustable ratchet wrench apparatus onto an object.

Still another object of the present invention is to provide a new and improved adjustable ratchet wrench apparatus which provides a unidirectional ratcheting mechanism.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved adjustable ratchet wrench apparatus embodying the principles and concepts of the present invention will be described.

Figure 1:
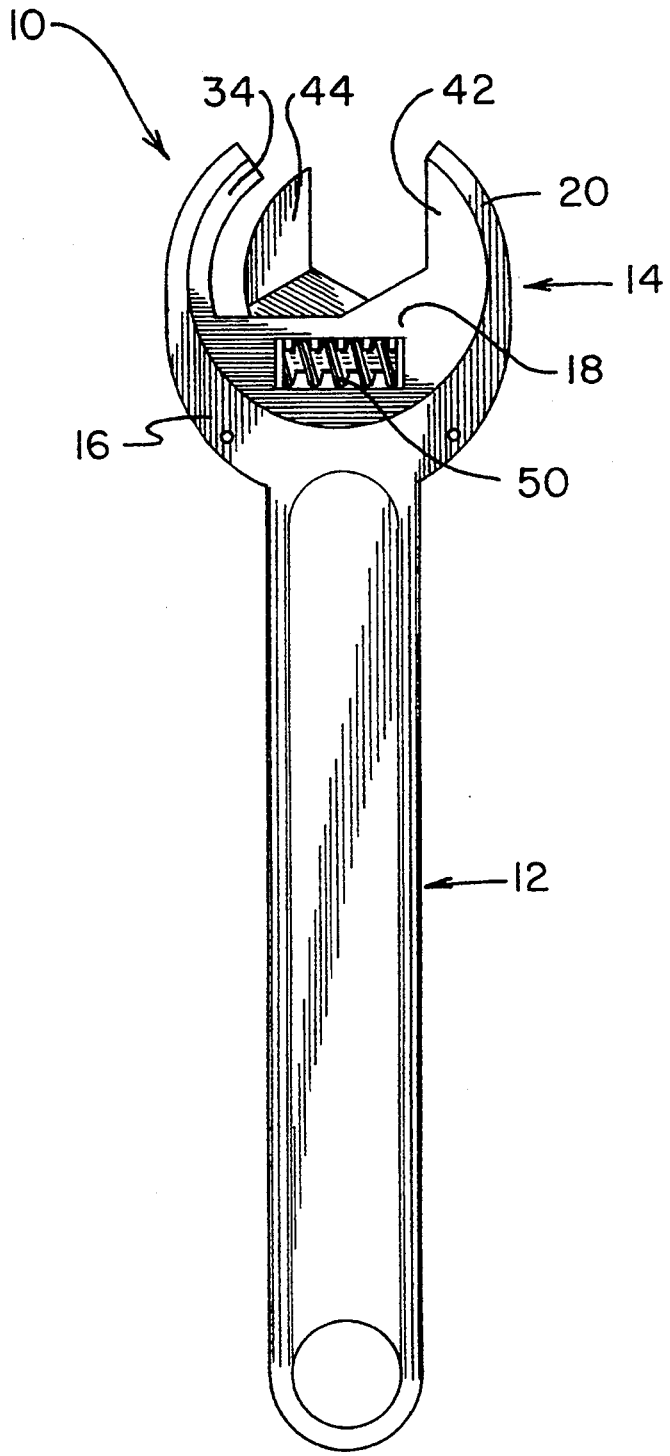
FIG. 1 is a top view showing a first preferred embodiment of the adjustable ratchet wrench apparatus of the invention which includes a unidirectional ratcheting mechanism and one adjustable jaw.
Figure 2:
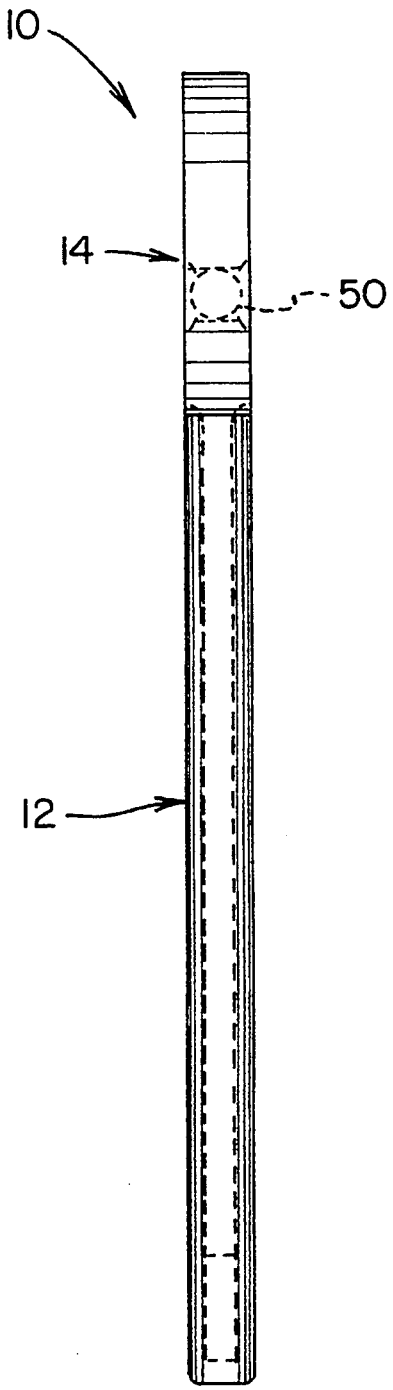
FIG. 2 is a side view of the embodiment of the invention shown in FIG. 1.

Turning to FIGS. 1–2, there is shown an exemplary first embodiment of the adjustable ratchet wrench apparatus of the invention generally designated by reference numeral 10. In its preferred form, adjustable ratchet wrench apparatus 10 includes a handle assembly 12 and a wrench head assembly 14 connected to the handle assembly 12. The wrench head assembly 14 includes a ratchet assembly 16 and a jaw assembly 18 supported by the ratchet assembly 16. The ratchet assembly 16 includes a ratchet assembly housing 20 connected to the handle assembly 12. The ratchet assembly housing 20 is substantially C-shaped and includes a base portion 22 connected to the handle assembly 12. A first free-ended portion 24 of the ratchet assembly housing 20 extends from the base portion 22, and a second free-ended portion 26 of the ratchet assembly housing 20 extends from the base portion 22. A first gap 28 is provided between a first free end 30 of the first free-ended portion 24 and a second free end 32 of the second free-ended portion 26.

The ratchet assembly 16 includes a first ratchet element 54 supported by the ratchet assembly housing 20. The first ratchet element 54 permits unidirectional rotation of the jaw assembly 18. The first ratchet element 54 is actuated by a user's finger and is secured in a selected ratchet position by spring-biased locking pin 55.

The jaw assembly 18 includes a substantially C-shaped jaw assembly housing 34 which is nested within and is supported by the ratchet assembly housing 20 for relative rotation between the ratchet assembly housing 20 and the jaw assembly housing 34. The jaw assembly housing 34 is capable of rotating 360 degrees repetitively within the ratchet assembly housing 20. The jaw assembly housing 34 includes peripheral gear teeth 35 that are engaged by the first ratchet element 54. A second gap 36 is provided between a first free end 38 and a second free end 40 of the jaw assembly housing 34.

The jaw assembly 18 includes a first jaw member 42 and a second jaw member 44 which are connected to the jaw assembly housing 34. The jaw assembly 18 includes a jaw-adjustment assembly 46 connected to the jaw assembly housing 34, for adjusting a third gap 48 between the first jaw member 42 and the second jaw member 44.

As stated above, the first ratchet element 54 permits unidirectional rotation of the jaw assembly 18. To provide for directional rotation in the opposite direction, the adjustable ratchet wrench apparatus 10 of the invention can be flipped over so that the unidirectional rotation will be in the opposite direction. The first jaw member 42 and the second jaw member 44 includes flat front surfaces for engaging a fastener such as a nut or bolt.

In the embodiments of the invention shown in FIGS. 1–4 and 7–9, the jaw-adjustment assembly 46 includes a unidirectionally threaded screw 50 supported by bearings 51 in the jaw assembly housing 34. The first jaw member 42 is fixed with respect to the jaw assembly housing 34, and the second jaw member 44 includes a threaded portion 52 which engages the unidirectionally threaded screw 50 such that the second jaw member 44 is movable by the unidirectionally threaded screw 50 with respect to the first jaw member 42. The second jaw member 44 is supported on a guide rod 53 that is supported by the jaw assembly housing 34, and the second jaw member 44 includes an internal channel through which the guide rod 53 passes.

Figure 3:
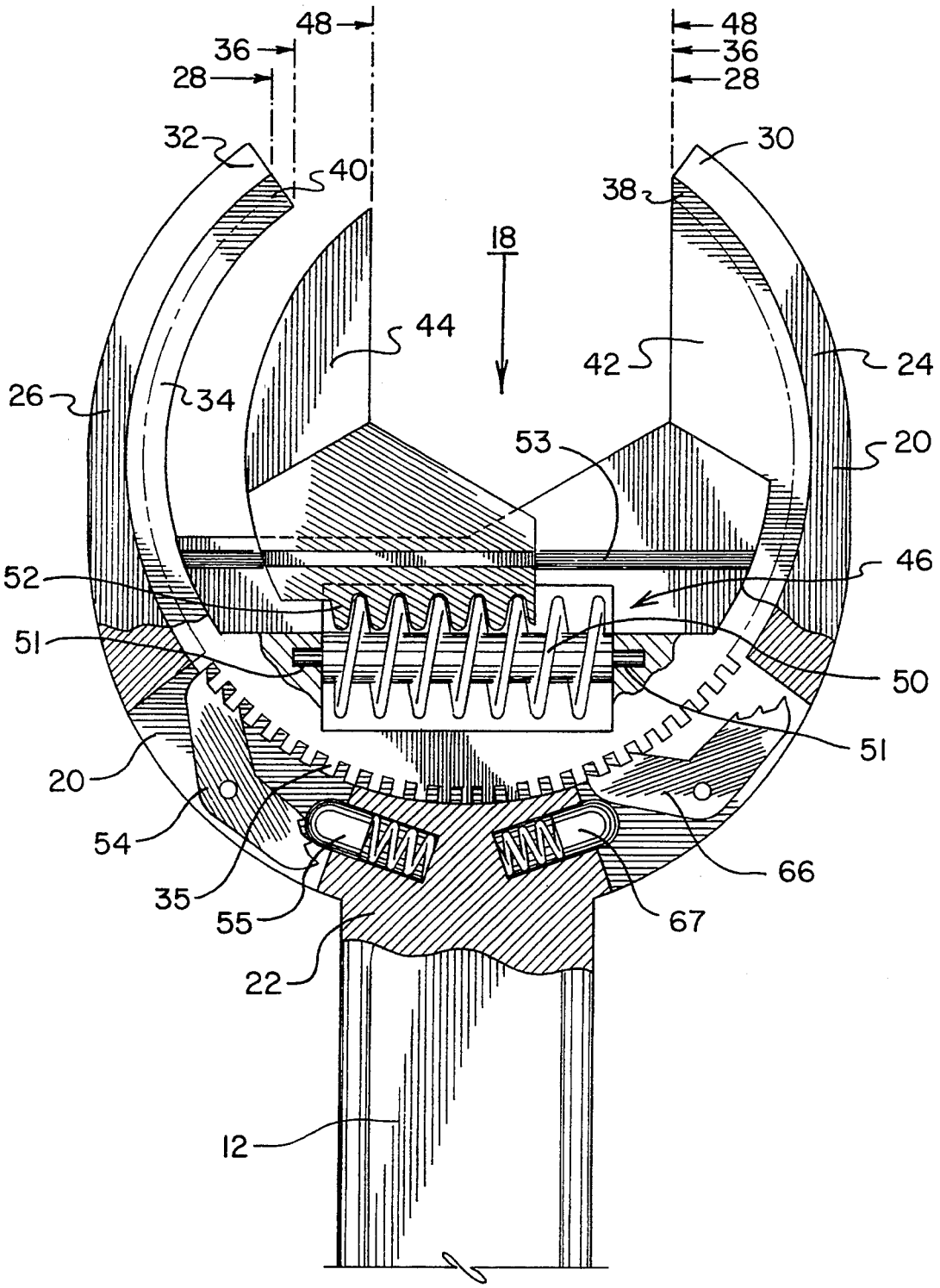
FIG. 3 is a partially broken away top view of the head portion and a part of the handle portion of a second embodiment of the adjustable ratchet wrench apparatus of the invention which includes two ratchets for bi-directional movement of the ratcheting mechanism.
Figure 4:
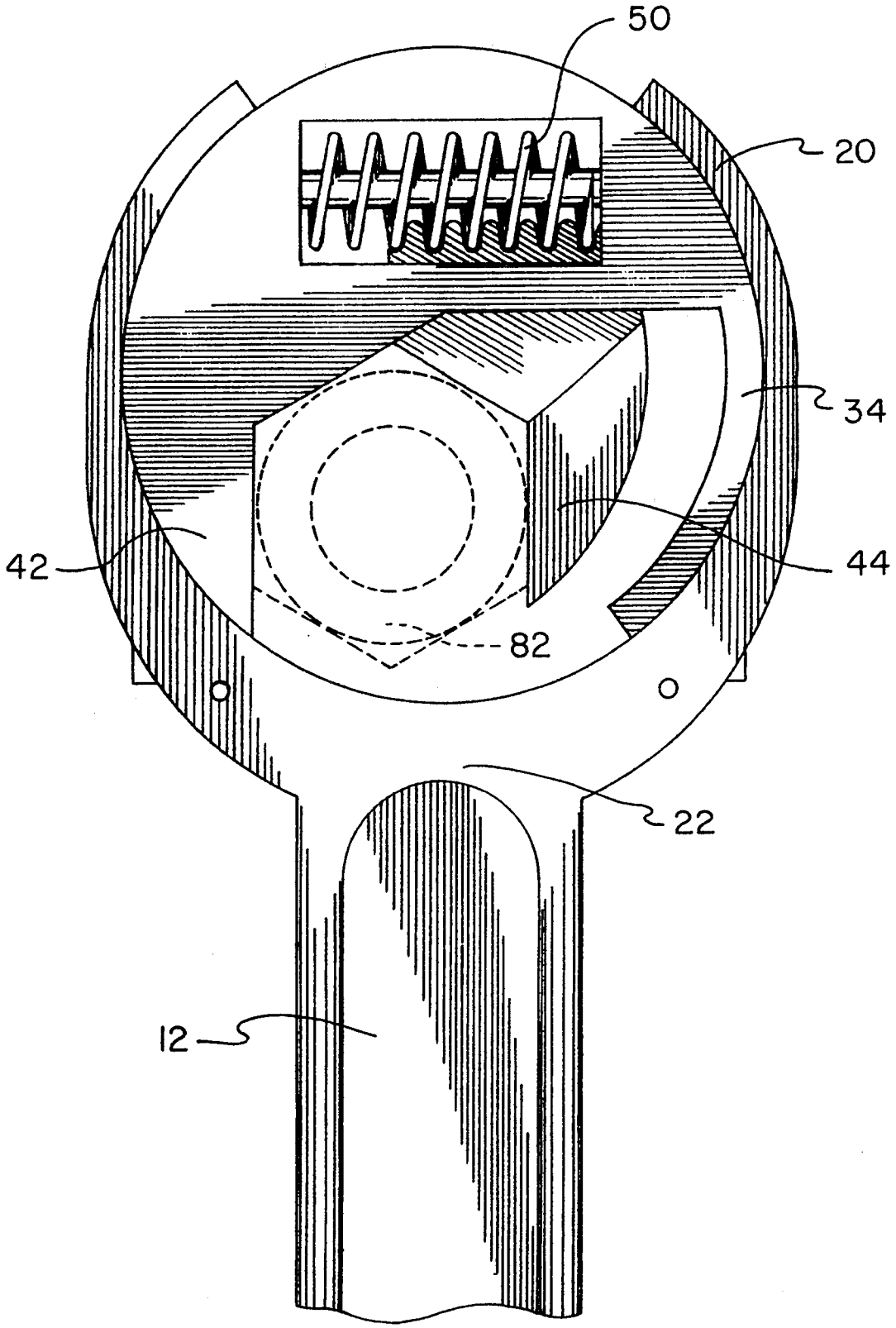
FIG. 4 is a top view of the portion of the embodiment of the invention shown in FIG. 3 with the apparatus placed on a six-sided nut and with the apparatus in use in turning the nut.

Aside from illustrating the principles of the invention implemented in the first embodiment, FIGS. 3 and 4 also illustrate a second embodiment of the invention. Reference numerals are shown that correspond to like reference numerals that designate like elements shown in the other figures. In addition, a second ratchet element 66 is supported by the ratchet assembly housing 20 for engaging the peripheral gear teeth 35 of the jaw assembly housing 34. The second ratchet element 66 permits unidirectional rotation of the jaw assembly 18 in a direction opposite to the unidirectional rotation of the jaw assembly 18 permitted by the first ratchet element 54. The second ratchet element 66 permits unidirectional rotation in a direction opposite to the unidirectional rotation permitted by the first ratchet element 54 without flipping the adjustable ratchet wrench apparatus 10 of the invention over. The second ratchet element 66 is actuated by a user's finger and is secured in the selected ratchet position by spring-biased locking pin 67.

In FIG. 3, the ends of the ratchet assembly housing 20 and the ends of the jaw assembly housing 34 are placed in registration such that the first jaw member 42 and the second jaw member 44 are capable of being placed on an object to be turned, e.g. a nut or bolt, in the manner of an open-ended wrench. Once the first jaw member 42 and the second jaw member 44 are placed around the object to be turned, the unidirectionally threaded screw 50 is turned to adjust the second jaw member 44 with respect to the first jaw member 42.

In FIG. 4, the adjustable ratchet wrench apparatus 10 of the invention has been placed in operation to turn the nut 82. The jaw assembly 18 has been rotated approximately 180 degrees with respect to the ratchet assembly 16.

Figure 5:
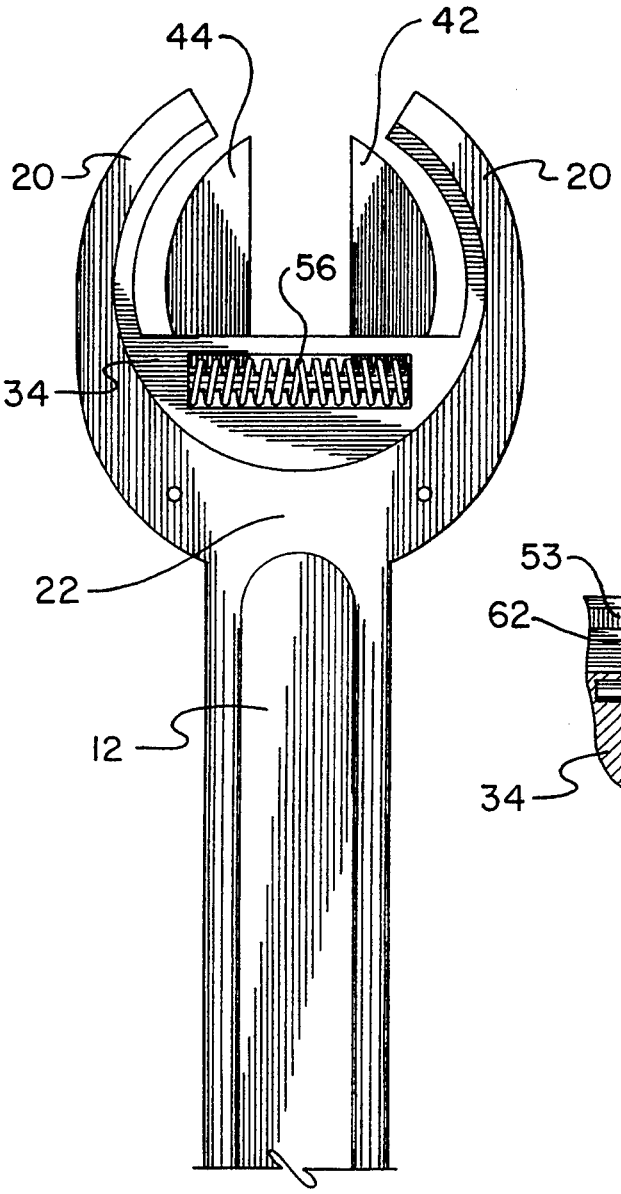
FIG. 5 is a top view of the head portion and a part of the handle portion of a third embodiment of the adjustable ratchet wrench apparatus of the invention which includes two adjustable jaws.
Figure 6:
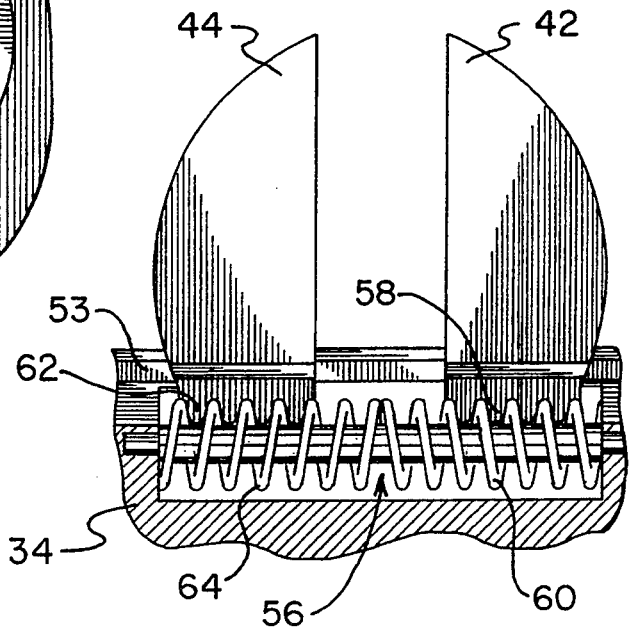
FIG. 6 is an enlarged top view of the jaw-adjustment portion of the embodiment of the invention shown in FIG. 5.

Turning to FIGS. 5–6, a third embodiment of the invention is shown. Reference numerals are shown that correspond to like reference numerals that designate like elements shown in the other figures. In addition, the jaw-adjustment assembly 46 includes a bidirectionally threaded screw 56 supported by the jaw assembly housing 34. The first jaw member 42 includes a threaded portion 58 which engages a first threaded portion 60 of the bidirectionally threaded screw 56 such that the first jaw member 42 is movable by the bidirectionally threaded screw 56 with respect to the jaw assembly housing 34. In addition, the second jaw member 44 includes a threaded portion 62 which engages a second threaded portion 64 of the bidirectionally threaded screw 56 such that the second jaw member 44 is movable by the bidirectionally threaded screw 56 with respect to the jaw assembly housing 34. The first jaw member 42 and the second jaw member 44 in the embodiment of the invention shown in FIGS. 5 and 6 are supported on a guide rod 53 that is supported by the jaw assembly housing 34. The first jaw member 42 and the second jaw member 44 have respective internal channels through which the guide rod 53 passes.

Figure 7:
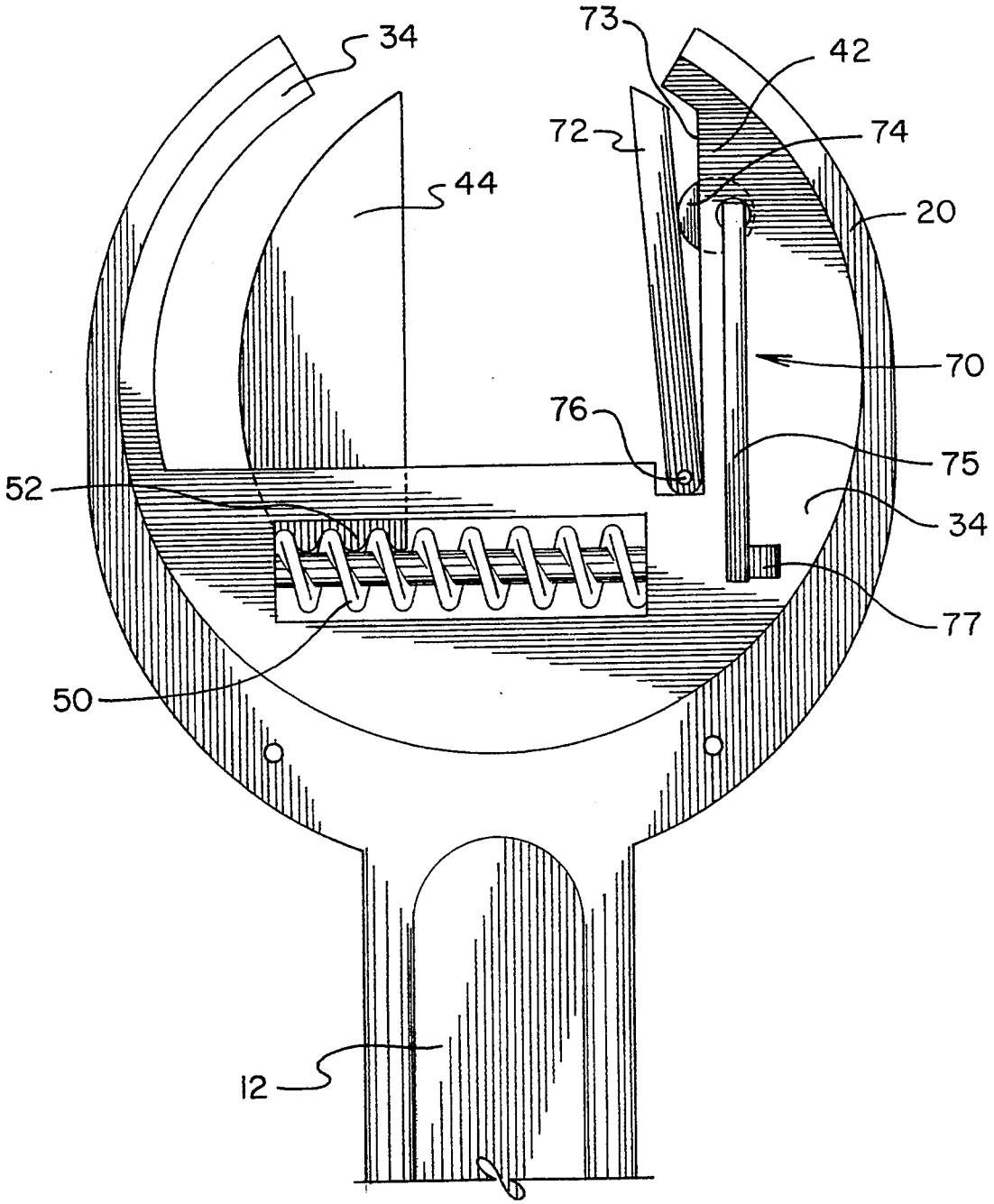
FIG. 7 is a top view of the head portion and a part of the handle portion of a fourth embodiment of the adjustable ratchet wrench apparatus of the invention which includes a mechanism for locking the jaws onto an object.
Figure 8:
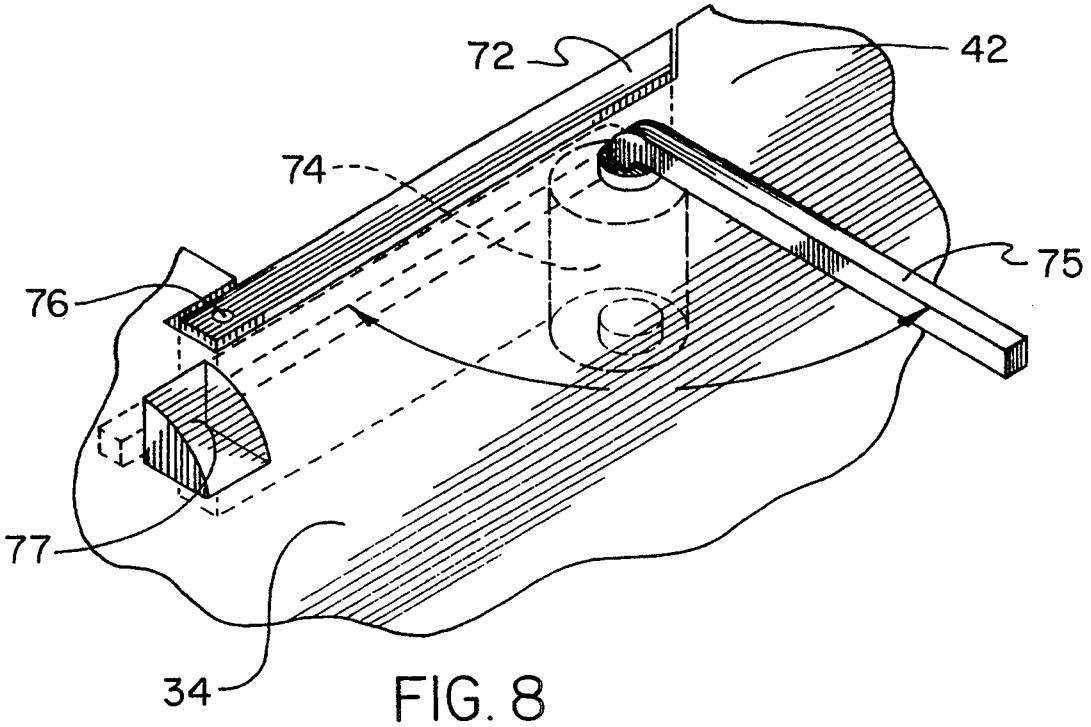
FIG. 8 is a partial perspective view of the jaw-locking mechanism shown in the embodiment of the invention shown in FIG. 7 wherein the jaw-locking mechanism is being adjusted by an Allen wrench.

Turning to FIGS. 7–8, a fourth embodiment of the invention is shown. Reference numerals are shown that correspond to like reference numerals that designate like elements shown in the other figures. The jaw-adjustment assembly 46 includes a unidircctionally threaded screw 50; the first jaw member 42 is fixed with respect to the jaw assembly housing 34; and the second jaw member 44 includes a threaded portion 52 which engages the unidirectionally threaded screw 50 such that the second jaw member 44 is movable by the unidirectionally threaded screw 50 with respect to the first jaw member 42. In addition, a jaw-locking assembly 70 is connected to the first jaw member 42.

The jaw-locking assembly 70 includes a pivoted face plate 72 juxtaposed to a front face 73 of the first jaw member 42. An eccentric locking cam 74 is supported by the first jaw member 42 and is located adjacent to the face plate 72. The eccentric locking cam 74 includes an unlocking mode in which the eccentric locking cam 74 is positioned such that a rear surface of the face plate 72 is permitted to be flush against front face 73 of the first jaw member 42. The eccentric locking cam 74 also include a continuum of locking modes in which the eccentric locking cam 74 is positioned such that the eccentric locking cam 74 pushes the face plate 72 away from the front face 73 of the first jaw member 42 and toward the second jaw member 44.

Normally, an object, such as a nut or bolt or pipe, is positioned between the face plate 72 and the second jaw member 44 of the jaw assembly 18. When the eccentric locking cam 74 is moved so that the face plate 72 is moved away from the front face 73 of the first jaw member 42 and toward the second jaw member 44, the object situated between the face plate 72 and the second jaw member 44 is locked between the face plate 72 and the second jaw member 44 by the eccentric locking cam 74. The pivoted face plate 72 rotates around pivot assembly 76 supported at the base of the first jaw member 42. The eccentric locking cam 74 includes a socket adapted to receive an Allen wrench 75, and an Allen wrench 75 is employed to operate the eccentric locking cam 74. A stop element 77 is supported by the jaw assembly housing 34 for preventing movement of the Allen wrench 75 when the Allen wrench 75 has been used to lock the eccentric locking cam 74 against the face plate 72.

Figure 9:
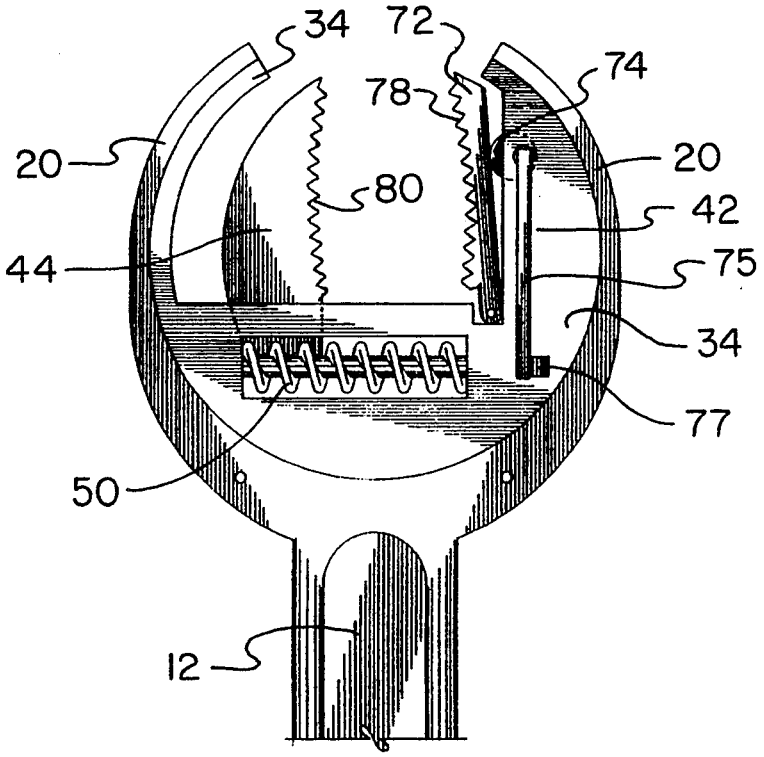
FIG. 9 is a top view of the head portion and a part of the handle portion of a fifth embodiment of the adjustable ratchet wrench apparatus of the invention which includes teeth-containing adjustable jaws and a jaw-locking mechanism.

Turning to FIG. 9, a fifth embodiment of the invention is shown. Reference numerals are shown that correspond to like reference numerals that designate like elements shown in the other figures. In addition, the face plate 72 includes a grooved front face 78 which faces toward the second jaw member 44, and the second jaw member 44 includes a grooved front face 80 which faces toward the face plate 72. The grooved front face 78 is concave, and the grooved front face 80 is concave. The concave grooved from face 78 of the face plate 72 and the concave grooved front face 80 of the second jaw member 44 facilitate the use of the adjustable ratchet wrench apparatus 10 of the invention on round objects such as pipes.

The components of the adjustable ratchet wrench apparatus of the invention can be made from inexpensive and durable metal materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved adjustable ratchet wrench apparatus that is low in cost, relatively simple in design and operation, and which may advantageously be used to avoid the need for a wide variety of differently sized sockets. With the invention, an adjustable ratchet wrench apparatus is provided which employs substantially all of the motion of the handle of the device in turning a nut or bolt. With the invention, an adjustable ratchet wrench apparatus is provided which includes an open-ended wrench. With the invention, an adjustable ratchet wrench apparatus is provided which does not employ a chain for gripping a pipe. With the invention, an adjustable ratchet wrench apparatus is provided which can have only one adjustable jaw. With the invention, an adjustable ratchet wrench apparatus is provided which can include a mechanism for locking the jaws of the adjustable ratchet wrench apparatus onto an object. With the invention, an adjustable ratchet wrench apparatus is provided which provides a unidirectional ratcheting mechanism.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved adjustable ratchet wrench apparatus, comprising:

a handle assembly, and a wrench head assembly connected to said handle assembly, wherein said wrench head assembly includes a ratchet assembly and a jaw assembly supported by said ratchet assembly, wherein said ratchet assembly includes a ratchet assembly housing connected to said handle assembly, wherein said ratchet assembly housing is substantially C-shaped and includes a base portion connected to said handle assembly, a first free-ended portion extending from said base portion, and a second free-ended portion extending from said base portion, wherein a first gap is provided between a first free end of said first free-ended portion and a second free end of said second free-ended portion, and wherein said ratchet assembly includes a first ratchet element supported by said ratchet assembly housing, said first ratchet element permitting unidirectional rotation of said jaw assembly, and wherein said jaw assembly includes a substantially C-shaped jaw assembly housing which is nested within and is supported by said ratchet assembly housing for relative rotation between said ratchet assembly housing and said jaw assembly housing, wherein said jaw assembly housing is capable of rotating 360 degrees repetitively within said ratchet assembly housing, wherein said jaw assembly housing includes peripheral gear teeth that are engaged by said first ratchet element, wherein a second gap is provided between a first free end and a second free end of said jaw assembly housing, wherein said jaw assembly includes a first jaw member and a second jaw member connected to said jaw assembly housing, and said jaw assembly includes a jaw-adjustment assembly, connected to said jaw assembly housing, for adjusting a third gap between said first jaw member and said second jaw member, wherein said jaw-adjustment assembly includes a unidirectionally threaded screw, wherein said first jaw member is fixed with respect to said jaw assembly housing, and wherein said second jaw member includes a threaded portion which engages said unidirectionally threaded screw such that said second jaw member is movable by said unidirectionally threaded screw with respect to said first jaw member, further including, a jaw-locking assembly connected to said first jaw member, wherein said jaw-locking assembly includes:

a pivoted face plate juxtaposed to a front face of said first jaw member, and an eccentric locking cam supported by said first jaw member and located adjacent to said face plate, said eccentric locking cam including an unlocking mode in which said eccentric locking cam is positioned such that a rear surface of said face plate is permitted to be flush against front face of said first jaw member, said eccentric locking cam also including a continuum of locking modes in which said eccentric locking cam is positioned such that said eccentric locking cam pushes said face plate away from said front face of said first jaw member and toward said second jaw member.

2. The apparatus described in claim 1 wherein:

said eccentric locking cam includes a socket adapted to receive an Allen wrench, and an Allen wrench is employed to operate said eccentric locking cam.

3. The apparatus described in claim 2, further including:

a stop element supported by said jaw assembly housing for preventing movement of said Allen wrench when said Allen wrench has been used to lock said eccentric locking cam against said face plate.

4. The apparatus described in claim 1 wherein:

said face plate includes a grooved front face which faces toward said second jaw member, and said second jaw member includes a grooved front face which faces toward said face plate.

5. The apparatus described in claim 4 wherein said grooved front face of said face plate is concave, and wherein said grooved front face of said second jaw member is concave.

* * * * *